US005390602A

United States Patent [19]

Görl

[11] Patent Number: 5,390,602

[45] Date of Patent: Feb. 21, 1995

[54] DEVICE FOR CLEANING INK-CARRYING SURFACES IN PRINTING UNITS

[75] Inventor: Gerhard Görl, Frankenthal, Germany

[73] Assignee: Heidelberger Druckmaschinen AG, Heidelberg, Germany

[21] Appl. No.: 43,000

[22] Filed: Apr. 5, 1993

[30] Foreign Application Priority Data

Apr. 4, 1992 [DE] Germany ..... 4211310

[51] Int. Cl.[6] ..... B41F 35/04

[52] U.S. Cl. ..... 101/425; 355/300; 101/423; 101/417

[58] Field of Search ..... 101/423, 424, 424.1, 101/424.2, 425, 416.1, 417; 355/296, 297, 299, 300, 301

[56] References Cited

U.S. PATENT DOCUMENTS

| | | | |
|---|---|---|---|
| 4,232,604 | 11/1980 | Waizmann | 101/425 |
| 4,270,450 | 6/1981 | Difflipp et al. | 101/142 |
| 4,344,361 | 8/1982 | MacPhee et al. | 101/425 |
| 4,344,362 | 8/1982 | Ishii | 101/423 |
| 4,651,644 | 3/1987 | Kaempfe et al. | 101/423 |
| 4,922,821 | 5/1990 | Nozaka et al. | 101/423 |
| 4,986,182 | 1/1991 | Sawaguchi et al. | 101/483 |
| 5,012,739 | 5/1991 | Loos et al. | 101/425 |
| 5,105,740 | 4/1992 | Loos et al. | 101/425 |
| 5,125,342 | 6/1992 | Hara | 101/425 |

FOREIGN PATENT DOCUMENTS

| | | |
|---|---|---|
| 2538105 | 4/1976 | Germany . |
| 203501 | 10/1983 | Germany . |
| 3810786 | 10/1988 | Germany . |
| 3909114 | 9/1990 | Germany . |
| 3909119 | 9/1990 | Germany . |
| 1401528 | 7/1975 | United Kingdom . |
| 1525255 | 9/1978 | United Kingdom . |

*Primary Examiner*—Edgar S. Burr
*Assistant Examiner*—Lynn D. Hendrickson
*Attorney, Agent, or Firm*—Herbert L. Lerner; Laurence A. Greenberg

[57] ABSTRACT

A cleaning unit for cleaning ink-carrying surfaces in printing units of rotary printing machines comprises a supply reel carrying a web of washcloth; a take-up reel for receiving washcloth from the supply reel; a drive for driving the take-up reel and a coupling for mechanically coupling the take-up reel with the drive; a pivotable guide element, the guide element deflecting the web of washcloth extending between the supply and take-up reels; and a device for simultaneously pivoting the guide element towards a surface to be cleaned and for transporting a portion of the web of washcloth from the supply reel to the take-up reel.

13 Claims, 5 Drawing Sheets

DEVICE FOR CLEANING INK-CARRYING SURFACES IN PRINTING UNITS

BACKGROUND OF THE INVENTION

1. Field of the Invention

The invention relates to a device for cleaning ink-carrying surfaces, for instance the outer cylindrical surfaces of transfer cylinders, in printing units of rotary printing machines.

2. Description of the Related Art

In prior art washing devices known from U.S. Pat. No. 5,012,739 and U.S. Pat. No. 5,105,740, the parts of the washing unit cooperating with the ink-carrying surface to be cleaned are embodied as actuable pressure elements. The pressure elements comprise an elastic part received in a U-shaped frame and, when pressurized air impinges thereon, a wash cloth is brought into contact with the ink-carrying surface. It is disadvantageous in those washing units that a width of the wash cloth employed therein is fixed by the width of the pressure element. When the washing units are to be used with surfaces which are wider, substantial modifications are required. It is furthermore found to be bothersome, when exchanging the washing unit embodied as an insert element, to interrupt supply lines each time and to reestablish the same after the exchange.

SUMMARY OF THE INVENTION

It is accordingly an object of the invention to provide a device for cleaning ink-carrying surfaces in printing units, which overcomes the hereinafore-mentioned disadvantages of the heretofore-known devices of this general type and which optimizes a washing unit such that compact construction, quick exchangeability and universal adaptability are attained.

With the foregoing and other objects in view there is provided, in accordance with the invention, a cleaning unit for cleaning ink-carrying surfaces in printing units of rotary printing machines, comprising: a supply reel carrying a web of washcloth; a take-up reel for receiving washcloth from the supply reel; drive means for driving the take-up reel and coupling means for mechanically coupling the take-up reel with the drive means; a pivotable guide element, the guide element being means for deflecting the web of washcloth extending between the supply and take-up reels; and means for simultaneously pivoting the guide element towards a surface to be cleaned and for transporting a portion of the web of washcloth from the supply reel to the take-up reel.

In accordance with an added feature of the invention, the means for simultaneously pivoting are in the form of drive elements capable of being coupled.

In accordance with an additional feature of the invention, the cleaning unit includes means for mechanically connecting the take-up reel with a drive element by insertion into guides.

The foregoing objects are thus solved in accordance with the invention, in that a transport of the washcloth and a positioning movement of the pivotable guide element or guide roller onto the ink-carrying surface of a transfer cylinder are effected simultaneously by coupled drive elements. The advantages attained with this solution are of diverse nature. Firstly, the cost of manufacture is substantially lowered by reducing the number of components to be employed. Secondly, it is possible in the future to dispense with the complicated and time-consuming unhooking of a pneumatic supply line when the slide-in washing unit of the invention is removed or inserted. The combination of washcloth transport with the approach operation allows for a reduction in structural components, thus saving space and expense.

In accordance with a further feature of the invention, the cleaning unit includes a pivot axis, and the transport of the washcloth and the approach movement of the pivotable guide element each take place about the same pivot axis.

In accordance with yet an added feature of the invention, a pivoting of the pivotable guide element defines a direction of approach towards the surface to be cleaned, and the unit includes means for pivoting the guide element and transporting the washcloth about the pivot axis in first and second directions of approach, the first direction of approach being angularly opposite the second direction of approach.

In accordance with yet an additional feature of the invention, the surface to be cleaned is an outer cylindrical surface of a transfer cylinder rotating in a given rotational direction, the direction of approach being oriented contrary to the given rotational direction.

In accordance with yet another feature of the invention, the guide element is a cylinder with an outer cylindrical surface, including a layer of flexible material disposed on the outer cylindrical layer of the guide element.

In accordance with another feature of the invention, the cleaning unit includes pivot levers, the guide element being rotationally mounted in the pivot levers.

In accordance with yet another feature of the invention, the drive means are disposed at a side of the cleaning unit defining a drive-side and one of the pivot levers is disposed at the drive-side, including bearing assemblies for the guide element and for the take-up reel mounted at the one pivot lever, the bearing assemblies being one-way couplings.

In accordance with again an added feature of the invention, the cleaning unit includes first and second side walls laterally bounding the cleaning unit, at least one traverse interconnecting the side walls, running rollers rotatably mounted on the side walls, rails disposed laterally of the side-walls having recesses formed therein for receiving the running rollers, and catch bolt means mounted in the side walls for arresting the side-walls in an inserted position.

In accordance with again an additional feature of the invention, the cleaning unit includes locking bolts for locking the supply reel and the take-up reel in one of side side-walls.

With the objects of the invention in view, there is further provided, in accordance with the invention, a cleaning unit for cleaning outer cylinder surfaces of ink-carrying cylinders in printing units of rotary printing machines, comprising: a washcloth supply roll and a dirty-washcloth take-up roll for a washcloth; guide means for deflecting the washcloth disposed between the supply roll and the take-up roll towards a surface to be cleaned; means for pivoting the guide means towards the surface to be cleaned; a drive element and means for mechanically coupling the take-up roll with the drive element; means for causing a simultaneous pivoting of the guide means towards the surface to be cleaned and a transport of the washcloth, the means being formed by mechanically coupled drive elements.

In accordance with a concomitant feature of the invention, the cleaning unit includes a pivot axis defining a pivoting motion of the guide means and a direction of transport of the washcloth.

Advantageous further developments of the inventive concept may be seen in the fact that the transport of the washcloth and the approach movement of the pivotable guide element each take place about one and the same pivot point. This leads to a simple control. An approach movement of the guide element about the pivot axis is possible in a first direction as well as in a second direction. The washing unit according to the invention may thus, for instance in sheet-fed rotatary printing presses, be used above the printing unit or below the paper path. Only the approach path must be adjusted relative to the circumstances. Also, the direction of transport of the washcloth is contrary to the sense of rotation of the transfer cylinder. This allows for a simple construction of the cleaning device because the counter-rotation leads to a tensioning of the washcloth between the guide element and the take-up reel and the efficiency of the cleaning operation is very high. Furthermore, the pivotable guide element is provided with a cover of flexible material which, when the washcloth is pressed onto the transfer cylinder, the washcloth snugly adheres to the cylinder in a concave fashion and thus increases the area of a cleaning sector on the transfer cylinder. The ends of the guide element are received in pivot levers. Bearing assemblies for the guide element and the take-up reel are disposed at the drive-side pivot lever. The bearings are embodied as one-way couplings. This causes the guide element and the take-up reel to rotate in the transport direction of the washcloth only during the transport of the washcloth.

Finally, sidewalls or lateral parts, which are interconnected through at least one transverse bar, receive spring catch bolts, in which the sidewall may be locked in the inserted position. The lateral parts roll on rails which mesh in recesses formed in rails disposed at a lower region of the walls. The ends of a supply roller and a take-up reel facing a first lateral part are received in .locking bolts. When the supply reel is depleted and the take-up reel is full, they can simply be unhooked by pulling the lock bolts. Subsequently, new reels may be hung into the device; if the device is to be used with a printing machine of a wider format, correspondingly wider reels may be provided after the transverse bar between the side parts has been exchanged.

Other features which are considered as characteristic for the invention are set forth in the appended claims.

Although the invention is illustrated and described herein as embodied in a device for cleaning ink-carrying surfaces in printing units, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
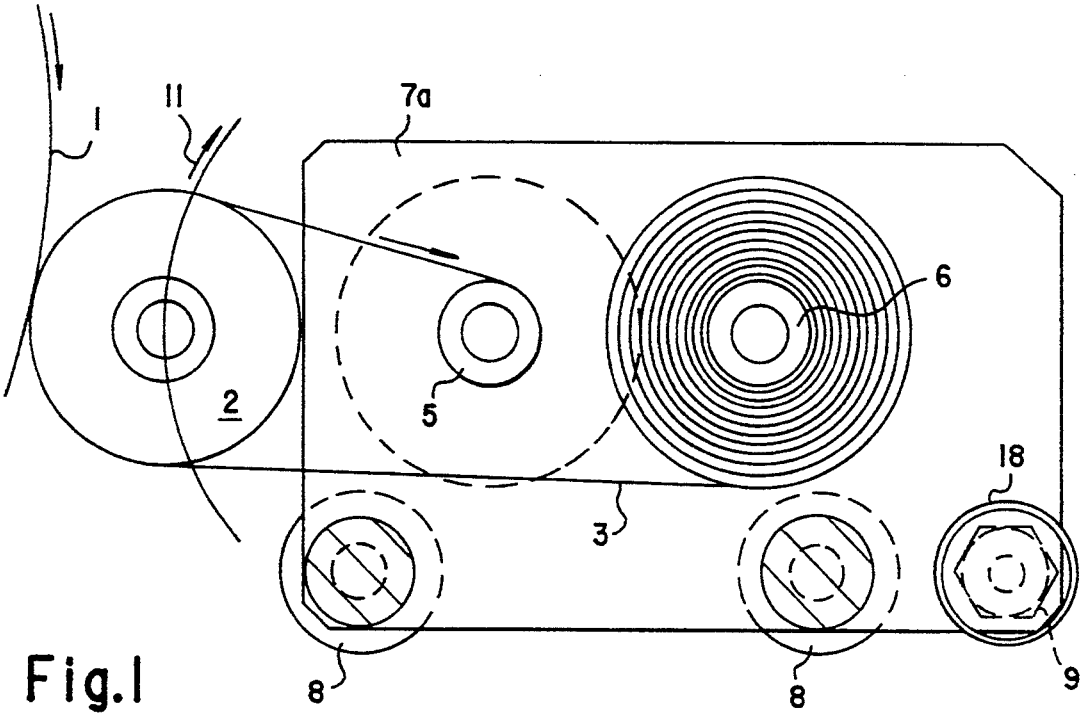
FIG. 1 is a side-elevational view of the cleaning unit adapted to a transfer cylinder rotating in a clockwise sense.

Referring now to the figures of the drawing in detail and first, particularly, to FIG. 1 thereof, there is seen a cleaning unit or washing unit with a transfer cylinder 1, which rotates in a clockwise sense. In this embodiment, a guide roller or guide element 2 is disposed, as referred to an axis of the transfer cylinder 1, 15°–30° below the rotational axis of the transfer cylinder 1 and it is pressed onto the ink-carrying surface of the transfer cylinder 1. A web of washcloth 3 from a supply roll or supply reel 6 is transported by a take-up roll or take-up reel 5 and guided about the guide element 2. The take-up reel 5 and the supply reel 6 are mounted in lateral parts or sidewalls *7a, 7b*. Only the lateral part *7a* is illustrated herein. The dashed line around the take-up reel 5 indicates the winding capacity up to which a used washcloth 3 may be received on the take-up reel 5 (see also FIG. 2).

Running rollers 8, 18 are disposed on the lateral parts *7a, 7b;* the rollers 8, 18 are received in guide members; the lateral parts *7a, 7b* are interconnected by means of a transverse bar or traverse 9. The reference numeral 11 shows the approach direction in which the guide element 2, in the context of this embodiment, is pivoted so as to come into contact with the outer cylindrical surface of the transfer cylinder 1.

Figure 2:
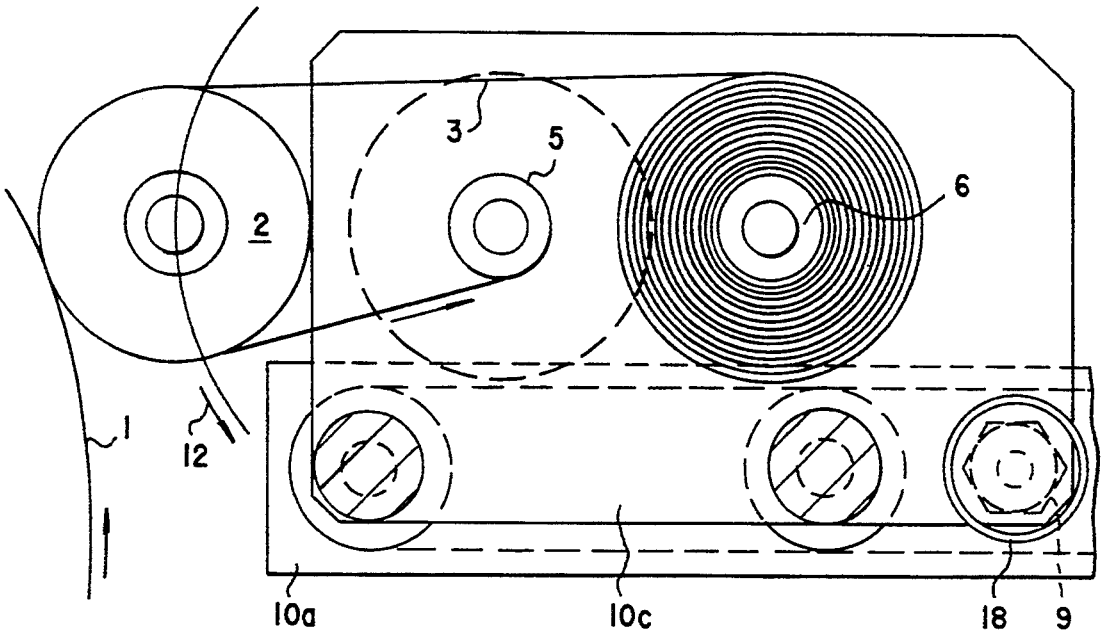
FIG. 2 is a similar view with a transfer cylinder rotating in a counter-clockwise sense.

FIG. 2 shows an embodiment of the washing unit adapted for a rotation of the transfer cylinder 1 in a counter-clockwise sense. The guide element 2, about which the washcloth 3 moves, is brought to bear against the outer cylindrical surface of the transfer cylinder 1. The guide element 2 has performed an approach movement in an approach direction 12 about the rotational axis of the take-up reel 5. In the embodiment shown in FIG. 2, the location of the guide element 2, and thus that of a touching strip of the washcloth 3, lies about 15°–30° above the rotational axis of the transfer cylinder 1. In contrast to the placement illustrated in FIG. 1, the used washcloth 3 rolls down from the guide element 2 and onto the take-up reel 5 from below. In the placement depicted in FIG. 1, the used washcloth 3 runs onto the take-up reel from above. In both placement embodiments, the washcloth 3 is transported in a direction contrary to the rotational direction of the transfer cylinder 1, which leads to better cleaning characteristics.

FIG. 2 further shows a rail 10a in which a recess 10*c* is formed. The recess 10*c* receives the running rollers 8 or 18 of the lateral parts *7a* and *7b*.

Figure 3A:
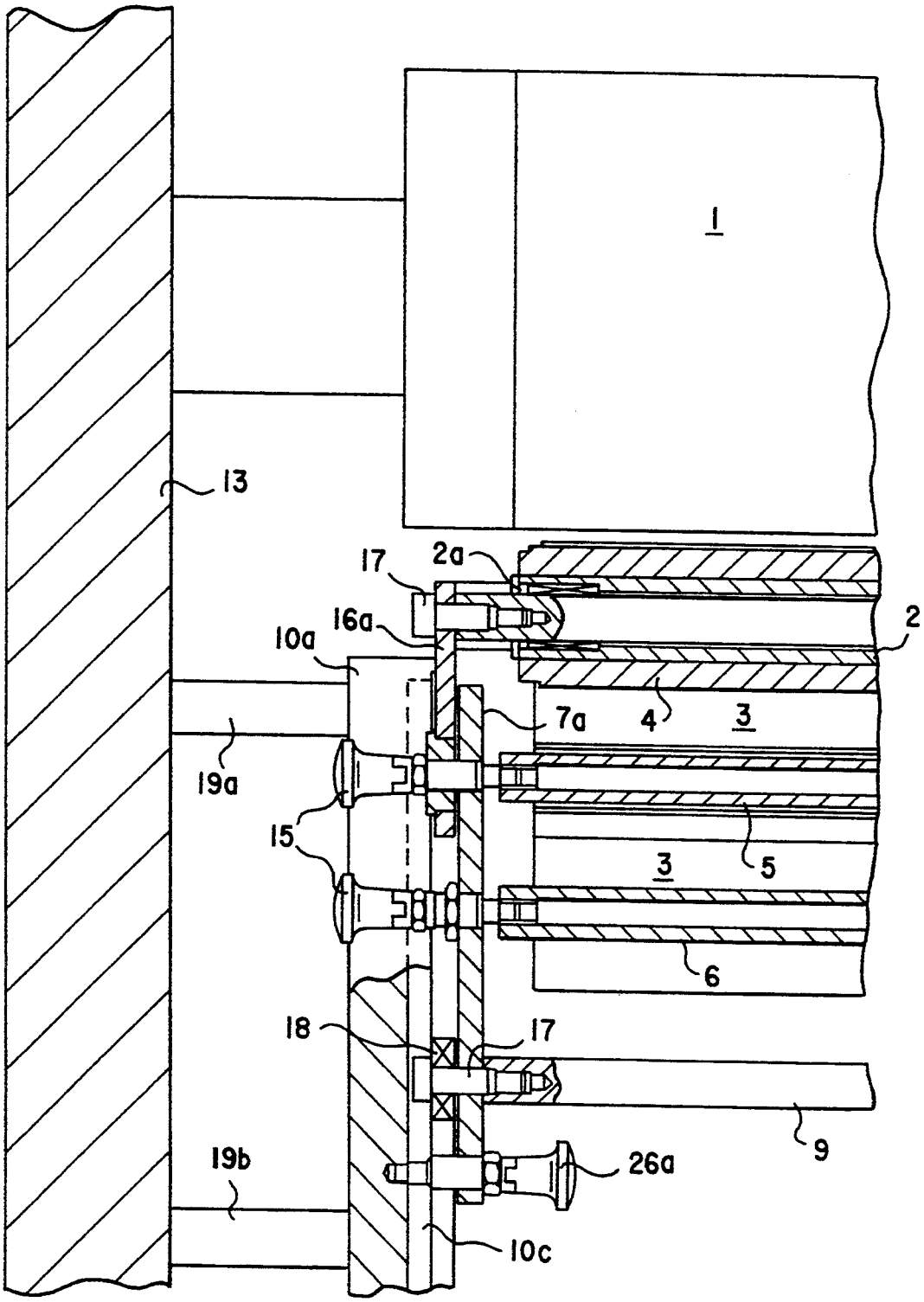
FIG. 3*a* is a partial top-plan view, partly in section, of the cleaning device.

FIG. 3*a* shows a partly broken-away top-plan view of a sectioned washing unit. In a wall 13 of a machine frame, there are disposed rail mounts 19*a* and 19*b*, and a trunnion of the transfer cylinder 1. The rail 10*a* with the recess 10*c* is carried in the rail mounts 19*a* and 19*b*. The running rollers 8 and 18 of the lateral part *7a* move in the recess 10c. The ends of the take-up reel 5 and the supply reel 6 are held in the lateral part *7a* via lock bolts 15.

In the illustrated condition, the supply reel 6 is still wound with several layers of the washcloth 3, while the take-up reel 5 has only received a few layers of the washcloth 3. A pivot lever 16a is disposed on a bushing about the lock bolt 15 assigned to the take-up reel 5. The pivot lever 16a carries a bearing 2a of the guide element 2 via a bolt 17 and a spacer element. The guide element 2 is jacketed with a layer 4, which has a high degree of elastic deformability and which regains it original shape after it is unloaded. The washcloth 3 is guided on the layer 4. When the guide element 2 is pressed against the transfer cylinder 1, the layer 4 causes snug adherence of the washcloth 3 onto the curved surface of the transfer cylinder 1. The flexible layer 4 thereby assumes a concave contour in correspondence with the surface curvature of the transfer cylinder 1. In this way, a corresponding strip of the washcloth 3 which extends across the width of the transfer cylinder 1 is pressed against the same and its ink-carrying surface is cleaned. An arresting bolt 26a is further disposed in the lateral part *7a*, with which the washing unit may be locked in the inserted position. The lock bolts 15 allow for an easy exchange of full or empty take-up reels 5 and supply reels 6 without a necessity to completely exchange the washing unit. With the use of correspondingly dimensioned traverses 9 and guide elements 2, the washing unit is universally employable, i.e. it may be used with various printing formats.

Figure 4A:
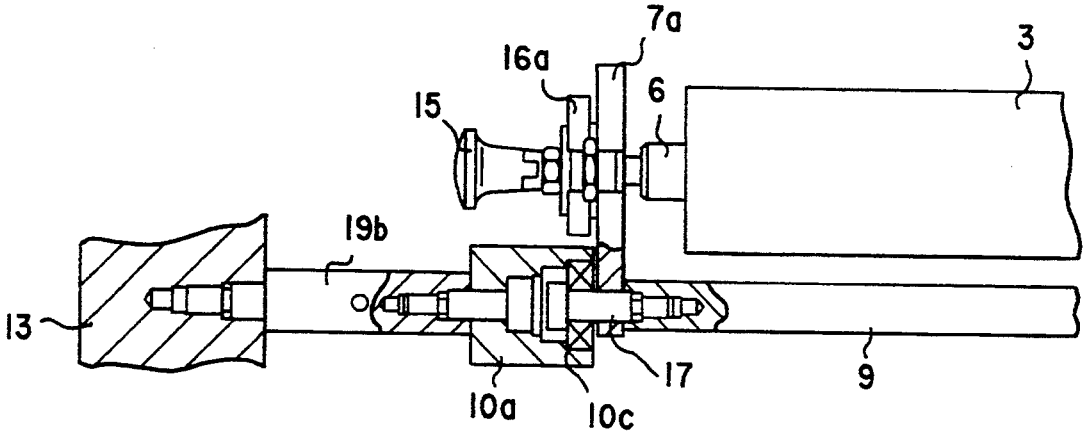
FIG. 4*a* is a partial front-elevational view of the cleaning unit with level track mounting.

FIG. 4a shows a front view of the washing unit with a level rail mount. Several layers of the washcloth 3 remain on the supply reel 6. The bolt 17, with which the traverse 9 and the running roller 18 are bolted onto the lateral part *7a* protrudes into the recess 10c of the rail 10a. The mounting of the mount bolt 19b at the rail 10a and the lateral wall 13 are shown on the opposite side.

Figure 3B:
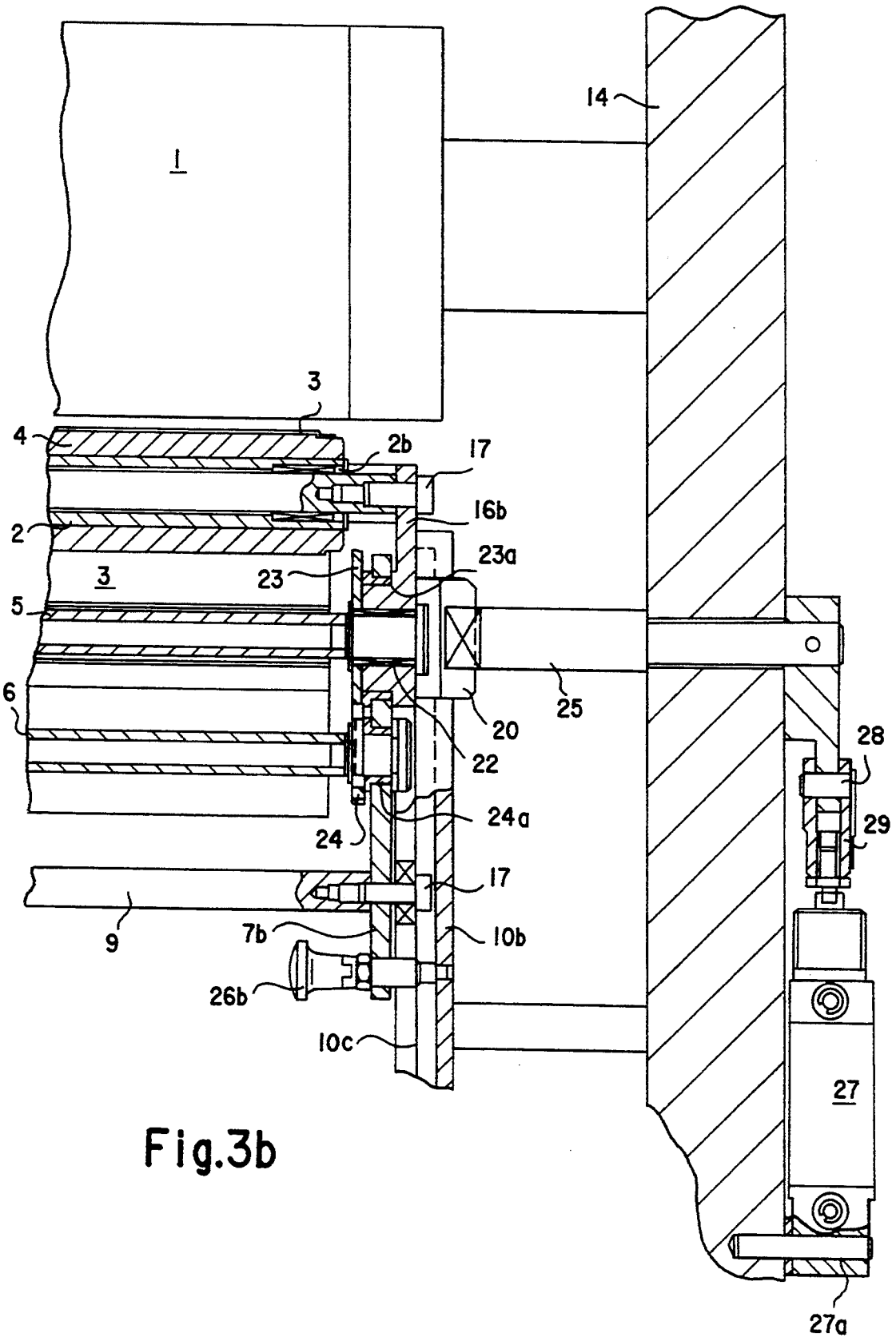
FIG. 3*b* is a view similar to that of FIG. 3*a* of a drive side of the cleaning unit.

FIG. 3b illustrates a top view of the drive side of the cleaning unit. The ends of the take-up reel 5 and the supply reel 6 and, via the pivot lever 16b, the drive-side end of the guide element 2 are carried in the drive-side lateral part *7b*. A bearing 2b with a one-way coupling fixes the guide element 2 against rotation in one direction, so that only a rotation of the guide element 2 can only occur in the direction of transport of the washcloth 3. As mentioned above, that direction depends on the embodiment and the direction of rotation of the transfer cylinder. The one-way coupling aids in the snug fit of the washcloth 3 against the layer 4 which adapts to the surface of the transfer cylinder 1. A bearing with a one-way coupling 22 is provided at the drive-side end of the take-up reel 5. This means that the take-up reel 5 can be rotated only in the direction of transport of the washcloth 3 as well. This attains an even tensing in the washcloth 3. The supply reel 6, whose drive-side end is also supported in the lateral part *7b*, is provided with a gear wheel 24. A spring-loaded ratchet 23 meshes with the gear wheel 24. After a portion of the washcloth 3 is unwound by rotating the take-up reel 5, the supply reel 6 is locked in its angular position until a further transport operation takes place. When the washing unit is inserted in the rails 10a, 10b, a form-locking connection results on the drive side between a four-cornered shaft 25a of a drive shaft 25 and a coupling 20. It is noted, in this context, that a form-locking connection is one which connects two elements together due to the shape of the elements themselves, as opposed to a force-locking connection, which locks the elements together by (frictional) force external to the elements. The four-cornered shaft 25a, when the washing unit is pushed in, reaches into a coupling slit 21 of the coupling 20. When the drive shaft 25 is rotated by a drive cylinder 27, the pivot lever 16b on the drive side pivots into a corresponding approach direction. Due to the bearing with the one-way coupling 22, the rotary motion simultaneously rotates the take-up reel 5 in such a way that the washcloth 3 is pulled into the direction of transport. At the same time, the supply reel 6 is also moved, until after a portion of the washcloth 3 has rolled off, the spring-loaded ratched 23 locks the gear wheel 24 of the supply reel 6. Due to this a strip of fresh washcloth 3 is pressed-on in the cleaning region at the surface to be cleaned and it cleans the surface of the transfer cylinder 1. The drive cylinder 27, which is rotatably mounted outside the side wall 14 moves about a counter-bearing 27a which is mounted stationary with regard to the machine. When the cleaning unit is exchanged, only the form-locking connection between the coupling slit 21 and the four-cornered shaft 25a is released in that the lateral parts *7a* and *7b* are pulled out of the rails 10a and 10b. By means of the control device of the washing unit, which is not further described in this context, the drive cylinder 27 is able to rotate the drive shaft 25 into one or the other approach directions 11 or 12—depending on the placement option—via a linkage 29, which is connected in a bolt 28.

Figure 4B:
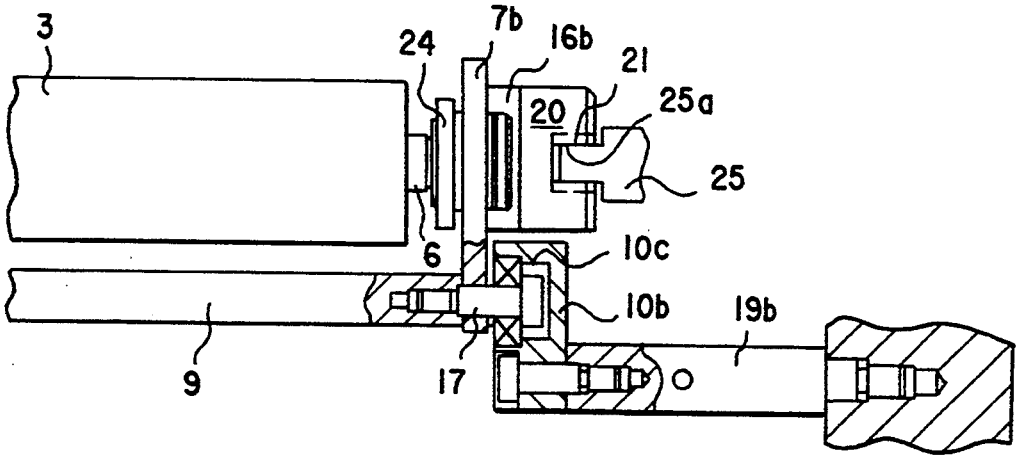
FIG. 4*b* is a view similar to that of FIG. 4*a* of the cleaning unit with offset track mounting.

FIG. 4b shows a front-elevational view of the washing unit with an offset rail mounting. In this configuration, with which lateral space may be saved, the attachment for the rail mount 19b and the recess 10c of the rail 10 are disposed one above the other. A locking bolt 26b of the drive-side lateral part *7b* which corresponds to the locking bolt 26a determines the insertion direction of the washing unit.

Figure 5:
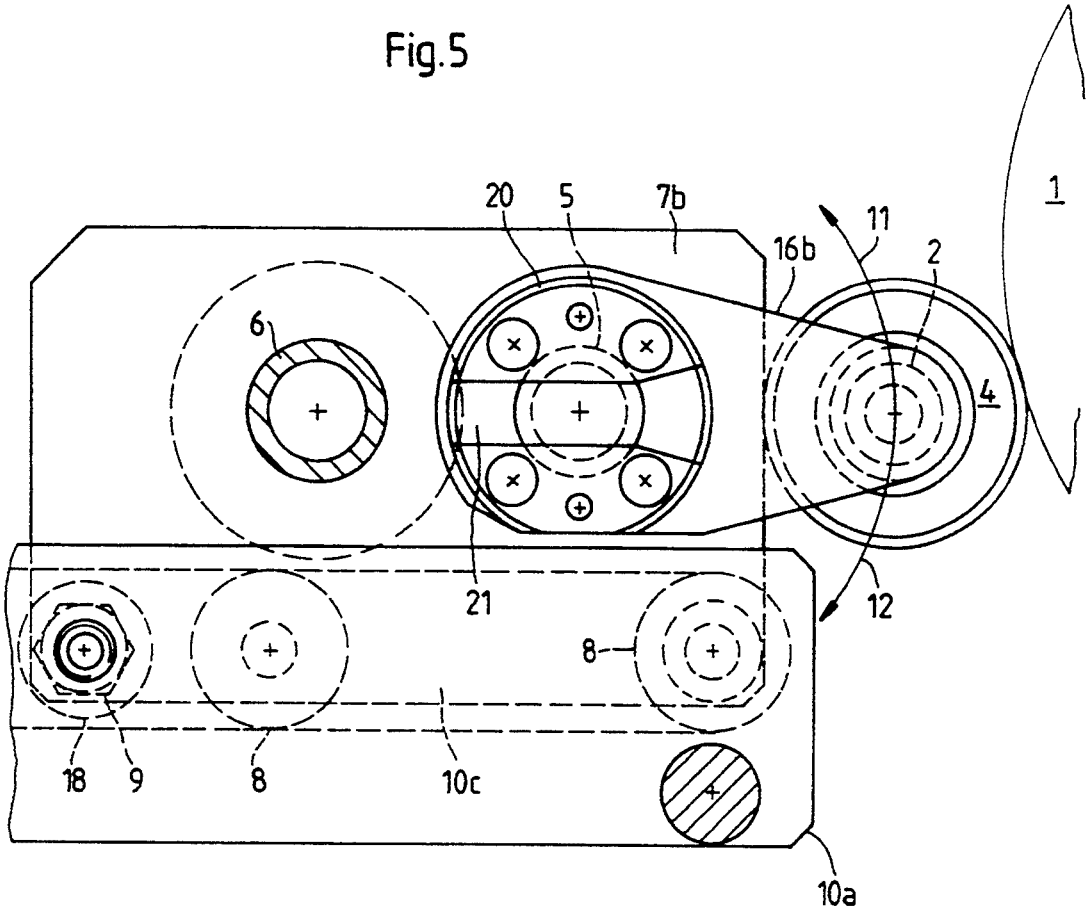
FIG. 5 is a side-elevational view of another embodiment of the cleaning unit.

After the locking bolts 26a, 26b are pulled, the cleaning or washing unit may be pulled out of the rails 10a and 10b, whereby the form-locking drive connection is immediately interrupted, while the supply lines are not interrupted. A non-illustrated washing-medium or cleanser dispensing device is disposed stationary with regard to the machine frame in such a way that the washcloth 3, prior to contacting the surface of the transfer cylinder 1 to be cleaned, may be saturated or impregnated with washing medium. Referring now to the side-elevational view of FIG. 5 of a third embodiment, the guide element 2, equipped with a flexible layer 4, may be pivoted into either approach directions 11 and 12. A non-illustrated pivot lever opposite the pivot lever 16b, it is understood, pivots parallel with the pivot lever 16b. A coupling slit 21 is provided in the coupling 20 which is flanged onto the pivot lever 16b; the coupling slit 21 has an widened inlet region. Due to the pivoting motion—for instance into the approach direction 11—the layer 4 on the guide element 2 is deformed and with its concavity becomes snugly pressed onto the transfer cylinder 1. By limiting the pivoting motion, the press-on force may be adjusted; the press-on characteristics may be further adjusted by way of a choice of suitable layers 4 for the guide element 2. In order to avoid any crease or groove-type damage on the transfer cylinder 1, the drive cylinder 27 may be provided with adjustable stops or the like.

I claim:

1. A cleaning unit for cleaning ink-carrying surfaces in printing units of rotary printing machines, comprising:

a supply reel carrying a web of washcloth; a take-up reel for receiving washcloth from said supply reel;

drive means for driving said take-up reel and coupling means for mechanically coupling said take-up reel with said drive means;

a pivotable guide element, said guide element being means for deflecting the web of washcloth extending between said supply and take-up reels; and means for simultaneously pivoting said guide element relative to said take-up reel towards an ink-carrying surface to be cleaned and for transporting a portion of the web of washcloth from said supply reel to said take-up reel.

2. The cleaning unit according to claim 1, wherein said means for simultaneously pivoting and transporting are in the form of drive elements capable of being coupled.

3. The cleaning unit according to claim 1, including a drive element for driving said take-up reel, guides connected to said drive element, and means for mechanically connecting said take-up reel with said drive element by insertion into said guides.

4. The cleaning unit according to claim 1, including a pivot axis, the transport of the washcloth and the approach movement of the pivotable guide element each taking place about said pivot axis.

5. The cleaning unit according to claim 4, wherein a pivoting of said pivotable guide element defines a direction of approach towards the surface to be cleaned, including means for pivoting said guide element and transporting said washcloth about said pivot axis in first and second directions of approach, said first direction of approach being angularly opposite said second direction of approach.

6. The cleaning unit according to claim 5, wherein the surface to be cleaned is an outer cylindrical surface of a transfer cylinder rotating in a given rotational direction, said direction of approach being oriented contrary to the given rotational direction.

7. The cleaning unit according to claim 1, wherein said guide element is a cylinder with an outer cylindrical surface, including a layer of flexible material disposed on said outer cylindrical layer of said guide element.

8. The cleaning unit according to claim 1, including pivot levers, said guide element being rotationally mounted in said pivot levers.

9. The cleaning unit according to claim 8, wherein said drive means are disposed at a side of the cleaning unit defining a drive-side and one of said pivot levers is disposed at said drive-side, including bearing assemblies for said guide element and for said take-up reel mounted at said one pivot lever, said bearing assemblies being one-way couplings.

10. The cleaning unit according to claim 1, including first and second side walls laterally bounding the cleaning unit, at least one traverse interconnecting said side walls, running rollers rotatably mounted on said side walls, and rails disposed laterally of said side-walls having recesses formed therein for receiving said running rollers, catch bolt means mounted in said side walls for arresting said side-walls in an inserted position.

11. The cleaning unit according to claim 10, including locking bolts for locking said supply reel and said take-up reel in one of side side-walls.

12. A cleaning unit for cleaning outer cylinder surfaces of ink-carrying cylinders in printing units of rotary printing machines, comprising:

a washcloth supply roll and a dirty-washcloth take-up roll for a washcloth;

guide means for deflecting a washcloth disposed between said supply roll and said take-up roll towards a surface to be cleaned;

means for pivoting said guide means towards the surface to be cleaned;

a drive element and means for mechanically coupling said take-up roll with said drive element;

means for causing a simultaneous pivoting of said guide means relative to said take-up roll towards an ink carrying surface to be cleaned and a transport of a washcloth, said means being formed by mechanically coupled drive elements.

13. The cleaning unit according to claim 12, including a pivot axis defining a pivoting motion of said guide means and a direction of transport of a washcloth.

* * * * *